US010746418B2

(12) United States Patent
Morishita et al.

(10) Patent No.: US 10,746,418 B2
(45) Date of Patent: Aug. 18, 2020

(54) OUTDOOR UNIT AND AIR-CONDITIONING APPARATUS USING THE SAME

(71) Applicant: Mitsubishi Electric Corporation, Tokyo (JP)

(72) Inventors: Yuya Morishita, Tokyo (JP); Hiroyuki Morimoto, Tokyo (JP); Keisuke Hokazono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 32 days.

(21) Appl. No.: 15/764,665

(22) PCT Filed: Nov. 4, 2016

(86) PCT No.: PCT/JP2016/082822
§ 371 (c)(1),
(2) Date: Mar. 29, 2018

(87) PCT Pub. No.: WO2017/078144
PCT Pub. Date: May 11, 2017

(65) Prior Publication Data

US 2018/0274799 A1 Sep. 27, 2018

(30) Foreign Application Priority Data

Nov. 6, 2015 (WO) ..... PCT/JP2015/081353

(51) Int. Cl.
*F24F 1/16* (2011.01)
*F24F 1/22* (2011.01)
(Continued)

(52) U.S. Cl.
CPC ..... *F24F 1/16* (2013.01); *F24F 1/22* (2013.01); *F24F 1/24* (2013.01); *F24F 1/38* (2013.01);
(Continued)

(58) Field of Classification Search
CPC ..... F24F 1/16; F24F 1/46; F24F 1/38; F24F 1/56; F24F 1/50; F24F 1/24
See application file for complete search history.

(56) References Cited

U.S. PATENT DOCUMENTS 7,258,606 B1 * 8/2007 Reid ..... F24F 1/027 312/101
2005/0144975 A1 * 7/2005 Fuchikami ..... F24F 1/20 62/508
(Continued)

FOREIGN PATENT DOCUMENTS

EP 2 146 151 A1 1/2010
JP H05-001924 U 1/1993
(Continued)

OTHER PUBLICATIONS

International Search Report of the International Searching Authority dated Jan. 31, 2017 for the corresponding International application No. PCT/JP2016/082822 (and English translation).

*Primary Examiner* — Kun Kai Ma
(74) *Attorney, Agent, or Firm* — Posz Law Group, PLC

(57) ABSTRACT

An outdoor unit including a compressor is configured to compress refrigerant, a heat source-side air sending device is configured to suck air, a heat source-side heat exchanger is configured to exchange heat between the refrigerant and the air, and a controller is configured to control the compressor, the heat source-side air sending device, and the heat source-side heat exchanger, in which the heat source-side air sending device is provided in an upper part of the outdoor unit, the controller is provided in a lower part of the outdoor unit, the heat source-side heat exchanger is provided along outer peripheral side surfaces of the outdoor unit, and a part of the heat source-side heat exchanger is provided along a
(Continued)

working plane used by an engineer for maintenance work and is provided above the controller.

13 Claims, 7 Drawing Sheets

(51) Int. Cl.
*F24F 1/46* (2011.01)
*F24F 1/24* (2011.01)
*F24F 1/38* (2011.01)
*F24F 1/50* (2011.01)
*F24F 1/56* (2011.01)

(52) U.S. Cl.
CPC ..... *F24F 1/46* (2013.01); *F24F 1/50* (2013.01); *F24F 1/56* (2013.01)

(56) References Cited

U.S. PATENT DOCUMENTS

2009/0077988 A1* 3/2009 Ishikawa ..... F24F 1/22 62/259.1
2009/0081940 A1* 3/2009 Jang ..... F24F 1/22 454/184
2010/0193164 A1* 8/2010 Wakatsuki ..... F24F 1/24 165/121
2011/0079033 A1 4/2011 Okuda et al.
2012/0195000 A1* 8/2012 Hika ..... F24F 1/24 361/692
2013/0103205 A1* 4/2013 Han ..... F24F 3/065 700/276
2013/0219940 A1* 8/2013 Yamashita ..... F25B 1/00 62/160
2015/0114014 A1* 4/2015 Choi ..... F24F 1/06 62/89
2015/0114021 A1* 4/2015 Oguri ..... H01L 23/473 62/259.2
2016/0123607 A1* 5/2016 Kikuchi ..... F24F 1/60 62/259.1
2016/0178261 A1* 6/2016 Kimura ..... F25B 13/00 62/155
2016/0252284 A1* 9/2016 Kibo ..... F24F 11/30 62/115
2016/0327303 A1* 11/2016 Tomita ..... F24F 11/89
2016/0377312 A1* 12/2016 Kojima ..... F24F 1/0003 165/247
2017/0016636 A1* 1/2017 Koo ..... F24F 1/24
2017/0248328 A1* 8/2017 Eskew ..... F24F 1/22
2017/0248336 A1* 8/2017 Yamane ..... F24F 11/89
2019/0301753 A1* 10/2019 Taniguchi ..... F24F 1/22

FOREIGN PATENT DOCUMENTS

JP 2002-130742 A 5/2002
JP 2002-243209 A 8/2002
JP 2005-113695 A 4/2005
JP 2009-299975 A 12/2009
JP 2010-065967 A 3/2010
JP 2013-079807 A 5/2013
JP 5291388 B2 6/2013
JP 2014-074567 A 4/2014
JP 3191953 U 7/2014
WO 2008/126390 A1 10/2008

* cited by examiner

OUTDOOR UNIT AND AIR-CONDITIONING APPARATUS USING THE SAME

CROSS REFERENCE TO RELATED APPLICATION

This application is a U.S. national stage application of International Application No. PCT/JP2016/082822, filed on Nov. 4, 2016, which claims priority to International Application No. PCT/JP2015/081353, filed on Nov. 6, 2015, the contents of which are incorporated herein by reference.

TECHNICAL FIELD

The present invention relates to an outdoor unit and an air-conditioning apparatus using the same, and more particularly, to a structure of the outdoor unit.

BACKGROUND

In an air-conditioning apparatus such as a multi-air-conditioning apparatus installed in a construction such as a building, it is desired to save a space under a state in which heat exchange performance provided by a heat exchanger is maintained or to increase the heat exchange performance under a state in which a whole size is maintained.

Consequently, in an outdoor unit for the air-conditioning apparatus that responds to the above-mentioned request, a proportion of a space occupied by the heat exchanger to an internal space inevitably increases.

For example, in a related-art outdoor unit having a rectangular parallelepiped outer shell, the heat exchanger is arranged along three of four side surfaces, that is, three side surfaces other than a side surface used for maintenance work, in consideration of maintainability.

As a method of increasing the heat exchange performance of the outdoor unit described above, for example, it is conceivable to increase the heat exchanger in size as compared to related-art heat exchangers. Specifically, for example, it is conceivable to arrange the heat exchanger along all the four side surfaces of the outdoor unit.

Further, a controller configured to control devices accommodated inside the outdoor unit is provided to the outdoor unit.

The controller is arranged in a flow passage of air flowing through the outdoor unit, and hence hinders ventilation. Thus, it is not preferred to arrange the controller at a position where a wind speed is particularly high, for example, in the vicinity of a fan casing such as in an upper part of the outdoor unit.

When the heat exchanger is arranged along all the side surfaces of the outdoor unit, however, there is left no space to arrange the controller that is required to be accessed externally through an opening port. Further, in this case, the heat exchanger is arranged even along the surface that is used for the maintenance work or other operations. Thus, the devices accommodated inside the outdoor unit cannot be maintained or replaced.

Consequently, to solve the problems described above, there has been proposed that the controller be arranged such that a part of the heat exchanger is not arranged at, of all the side surfaces of the outdoor unit, a portion around a predetermined surface that is used for the maintenance work or other works, for example, at a front right corner or at a front left corner (see, for example, Patent Literature 1).

In this manner, the space for arrangement of the controller can be ensured while the heat exchanger is arranged along all the side surfaces of the outdoor unit.

Further, to reduce the space for arrangement of the controller as much as possible, there has been proposed the controller having a multi-layer structure of two or more layers in which one of the controller layers in the front side is of an opening-closing type to be openable and closeable (see, for example, Patent Literature 2).

PATENT LITERATURE

Patent Literature 1: Japanese Unexamined Patent Application Publication No. 2013-79807

Patent Literature 2: Japanese Patent No. 5291388

When the heat exchanger is arranged along three side surfaces as in the related art, the space for arrangement of the controller and a space for the maintenance work or other operations can be ensured. However, there is a problem in that it is difficult to increase the space for arrangement of the heat exchanger.

Further, with the method disclosed in Patent Literature 1, the controller is arranged at the position in the upper part of the outdoor unit where the wind speed is high. Consequently, there is a problem in that the space inside the outdoor unit cannot be efficiently used.

Still further, with the method disclosed in Patent Literature 2, the controller has the multi-layer structure and one of the controller layers is of an opening-closing type. Hence, the controller projects out of the outdoor unit during the maintenance work. Consequently, during the maintenance work, the controller is required to be covered with a protective covering for protection from rain, wind, and dust. Thus, there is a problem in that it is difficult to easily carry out the maintenance work.

SUMMARY

The present invention has been made in view of the above-mentioned problems in the related art, and has an object to provide an outdoor unit that is capable of easily improving both heat exchange performance and workability, and an air-conditioning apparatus using the outdoor unit.

According to one embodiment of the present invention, there is provided an outdoor unit including a compressor configured to compress refrigerant, a heat source-side air sending device configured to suck air, a heat source-side heat exchanger configured to exchange heat between the refrigerant and the air, and a controller configured to control the compressor, the heat source-side air sending device, and the heat source-side heat exchanger, in which the heat source-side air sending device is provided in an upper part of the outdoor unit, the controller is provided in a lower part of the outdoor unit, the heat source-side heat exchanger is provided along outer peripheral side surfaces of the outdoor unit, and a part of the heat source-side heat exchanger is provided along a working plane used by an engineer for maintenance work and is provided above the controller.

As described above, according to one embodiment of the present invention, the controller is provided on a bottom surface of the outdoor unit, and the heat source-side heat exchanger is provided on an upper surface side of the outdoor unit where a wind speed of air is high and on the working plane side. Consequently, both the heat exchange performance and the workability can be improved.

DETAILED DESCRIPTION

Embodiment 1

An air-conditioning apparatus according to Embodiment 1 of the present invention is described below.

Figure 1:
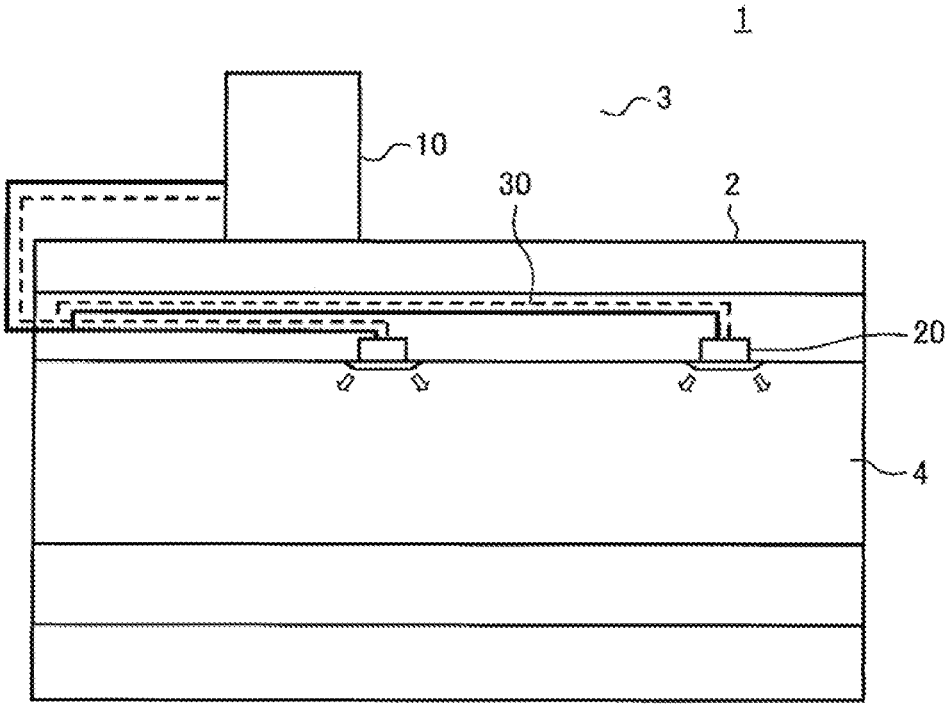
FIG. 1 is a schematic view for illustrating an example of installation of an air-conditioning apparatus according to Embodiment 1 of the present invention.

FIG. 1 is a schematic view for illustrating an example of installation of an air-conditioning apparatus 1 according to Embodiment 1 of the present invention.

As illustrated in FIG. 1, the air-conditioning apparatus 1 includes one outdoor unit 10 serving as a heat source device and a plurality of indoor units 20. The outdoor unit 10 and the plurality of indoor units 20 are connected by two refrigerant pipes 30. Through the pipes 30, refrigerant flows.

(Example of Installation of Air-Conditioning Apparatus)

The outdoor unit 10 is generally installed in a space outside of a construction 2 such as a building, for example, an outdoor space 3 such as on a rooftop or in other spaces, and is configured to generate cooling energy or heating energy to supply the cooling energy or the heating energy to the indoor units 20.

The indoor units 20 are installed in a space inside the construction 2, for example, an indoor space 4 such as a living space or a server room, and are configured to supply, to the indoor space 4, cooling air or heating air generated with the cooling energy or the heating energy supplied from the outdoor unit 10. Further, the indoor units 20 can be installed, for example, under a floor, to be used for floor heating for heating a floor surface with the heating energy supplied during a heating operation.

The number of indoor units 20 connected to the outdoor unit 10 is not limited to that in this example. For example, one indoor unit 20, or two or four or more indoor units 20 may be connected to one outdoor unit 10. Further, for example, one or a plurality of indoor units 20 may be connected to a plurality of outdoor units 10. Specifically, the number of outdoor units 10 and the number of indoor units 20 can be suitably determined corresponding to dimensions or other elements of the construction 2 in which the air-conditioning apparatus 1 is installed.

Further, an example where the outdoor unit 10 is installed in the outdoor space 3 is illustrated in FIG. 1. However, a location where the outdoor unit 10 is installed is not limited to that in this example. For example, the outdoor unit 10 may be installed in a machine room having an air vent or other places, and may also be installed inside the construction 2 as long as waste heat can be rejected out of the construction 2.

In this case, in the air-conditioning apparatus 1 according to Embodiment 1, as the refrigerant to circulate through a refrigerant cycle circuit, a single component refrigerant such as R-22, R-134a, and R-32, a near-azeotropic refrigerant mixture such as R-410A and R-404A, a non-azeotropic refrigerant mixture such as R-407C, a refrigerant having a double bond in a chemical formula, which is regarded as having a relatively small value of a global warming potential, such as $CF_3CF{=}CH_2$, a mixture of such a refrigerant having a double bond, or a natural refrigerant such as $CO_2$ and propane can be used.

(Circuit Configuration of Air-Conditioning Apparatus)

Figure 2:
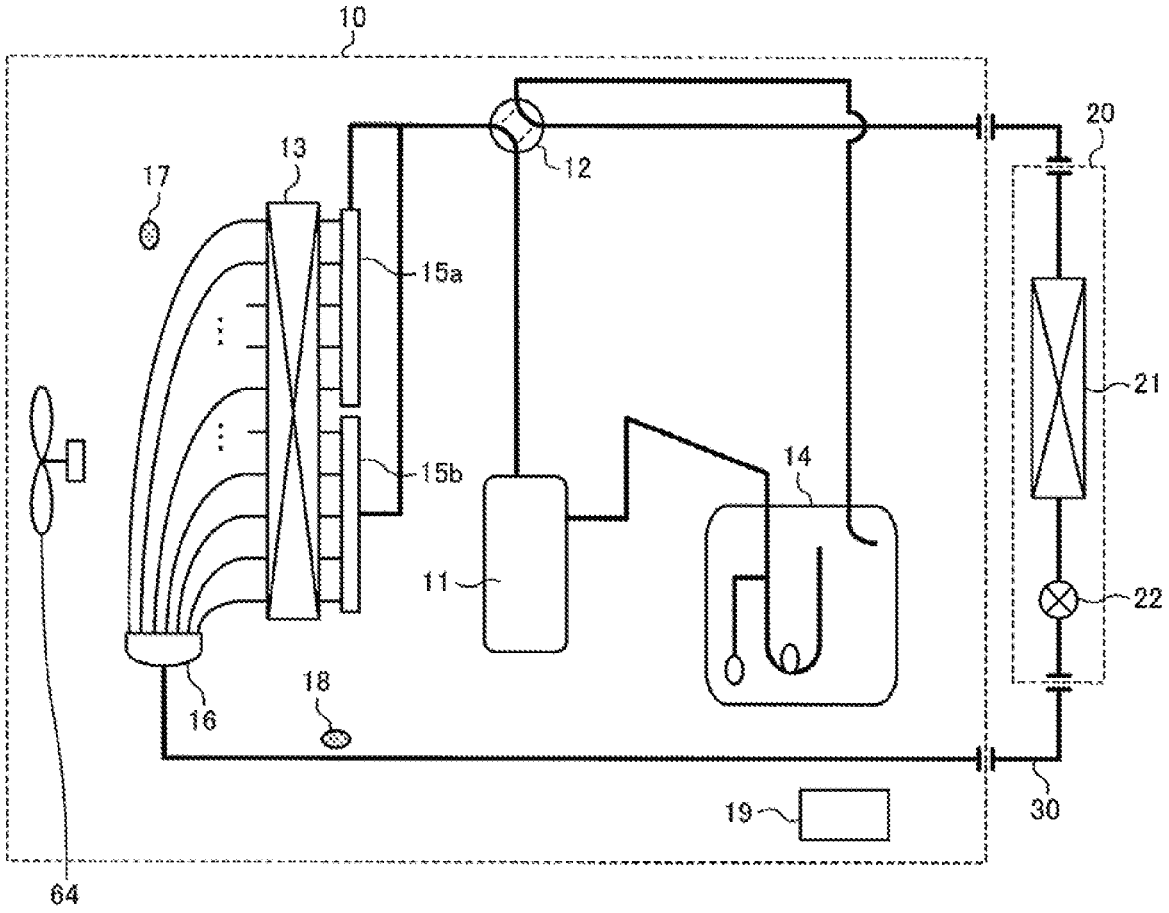
FIG. 2 is a schematic view for illustrating an example of a circuit configuration of the air-conditioning apparatus according to Embodiment 1 of the present invention.

FIG. 2 is a schematic view for illustrating an example of a circuit configuration of the air-conditioning apparatus 1 according to Embodiment 1 of the present invention.

In the example of FIG. 2, there is illustrated a case where one indoor unit 20 is connected to one outdoor unit 10 through the refrigerant pipes 30. The number of outdoor units 10 and the number of indoor units 20 are not limited to those in this example, as described above.

(Outdoor Unit)

The outdoor unit 10 includes a compressor 11, a refrigerant flow switching device 12 such as a four-way valve, a heat source-side heat exchanger 13, an accumulator 14, and a controller 19.

The refrigerant flow switching device 12 and the heat source-side heat exchanger 13 are coupled through a header 15*a* and a header 15*b*. The header 15*a* and the header 15*b* are connected to one end portion of the heat source-side heat exchanger 13. Further, capillary tubes 16 are connected to the other end portion of the heat source-side heat exchanger 13.

The compressor 11 is configured to suck low-temperature and low-pressure refrigerant, compress the refrigerant into a high-temperature and high-pressure state, and discharge the refrigerant. As the compressor 11, for example, an inverter compressor capable of controlling a capacity that is a refrigerant sending amount per unit time by arbitrarily changing a driving frequency can be used.

The refrigerant flow switching device 12 is configured to switch a direction of flow of the refrigerant to switch between a cooling operation and the heating operation. For example, the four-way valve can be used as the refrigerant flow switching device 12. However, other valves may be used in combination.

The heat source-side heat exchanger 13 is configured to exchange heat between the refrigerant and air (hereinafter suitably referred to as "outdoor air") supplied by a heat source-side air sending device 64 such as a fan. Specifically, the heat source-side heat exchanger 13 serves as a condenser configured to reject heat of the refrigerant to the outdoor air to condense the refrigerant during the cooling operation. Further, the heat source-side heat exchanger 13 serves as an evaporator configured to evaporate the refrigerant to cool the outdoor air by heat of evaporation generated at the time of evaporation during the heating operation.

The accumulator 14 is provided on a low-pressure side that is a suction side of the compressor 11. The accumulator 14 is configured to store surplus refrigerant generated due to a difference between an operating state during the cooling operation and an operating state during the heating operation, surplus refrigerant due to a transient operation change, or other surplus refrigerant.

An outside-air temperature sensor 17 is provided in the vicinity of the heat source-side heat exchanger 13 and is configured to measure a temperature of the outdoor air supplied to the heat source-side heat exchanger 13. Then, the outside-air temperature sensor 17 supplies information indicating the measurement result to the controller 19 described later.

A liquid-refrigerant temperature sensor 18 is provided on a refrigerant outflow side of the heat source-side heat exchanger 13 during the cooling operation or a refrigerant inflow side of the heat source-side heat exchanger 13 during the heating operation, and is configured to measure a temperature of liquid refrigerant flowing out of the heat source-side heat exchanger 13 during the cooling operation and a temperature of the liquid refrigerant flowing into the heat source-side heat exchanger 13 during the heating operation. Then, the liquid-refrigerant temperature sensor 18 supplies information indicating the measurement result to the controller 19.

The controller 19 is configured to control various devices in the air-conditioning apparatus 1 corresponding to, for example, the information indicating the measurement results supplied from the outside-air temperature sensor 17 and the liquid-refrigerant temperature sensor 18 and information supplied from various devices included in the air-conditioning apparatus 1. In particular, in Embodiment 1, the controller 19 adjusts a flow rate of the refrigerant in the headers 15*a* and 15*b*.

(Indoor Unit)

The indoor unit 20 is configured to, for example, cool and heat air in a space to be air-conditioned. The indoor unit 20 includes a use-side heat exchanger 21 that is an indoor heat exchanger and an expansion device 22.

The use-side heat exchanger 21 is configured to exchange heat between the refrigerant and air supplied by a use-side air sending device such as a fan (not shown). In this manner, the heating air or the cooling air to be supplied to the indoor space 4 is generated.

The use-side heat exchanger 21 serves as an evaporator to cool the air in the space to be air-conditioned to perform cooling when the refrigerant transfers the cooling energy during the cooling operation. Further, the use-side heat exchanger 21 serves as a condenser to heat the air in the space to be air-conditioned to perform heating when the refrigerant transfers the heating energy during the heating operation.

The expansion device 22 is configured to decompress the refrigerant to expand the refrigerant. The expansion device 22 is formed of a valve capable of controlling an opening degree of, for example, an electronic expansion valve.

(Structure of Outdoor Unit)

Next, a structure of the outdoor unit 10 in the air-conditioning apparatus 1 according to Embodiment 1 is described.

Figure 3:
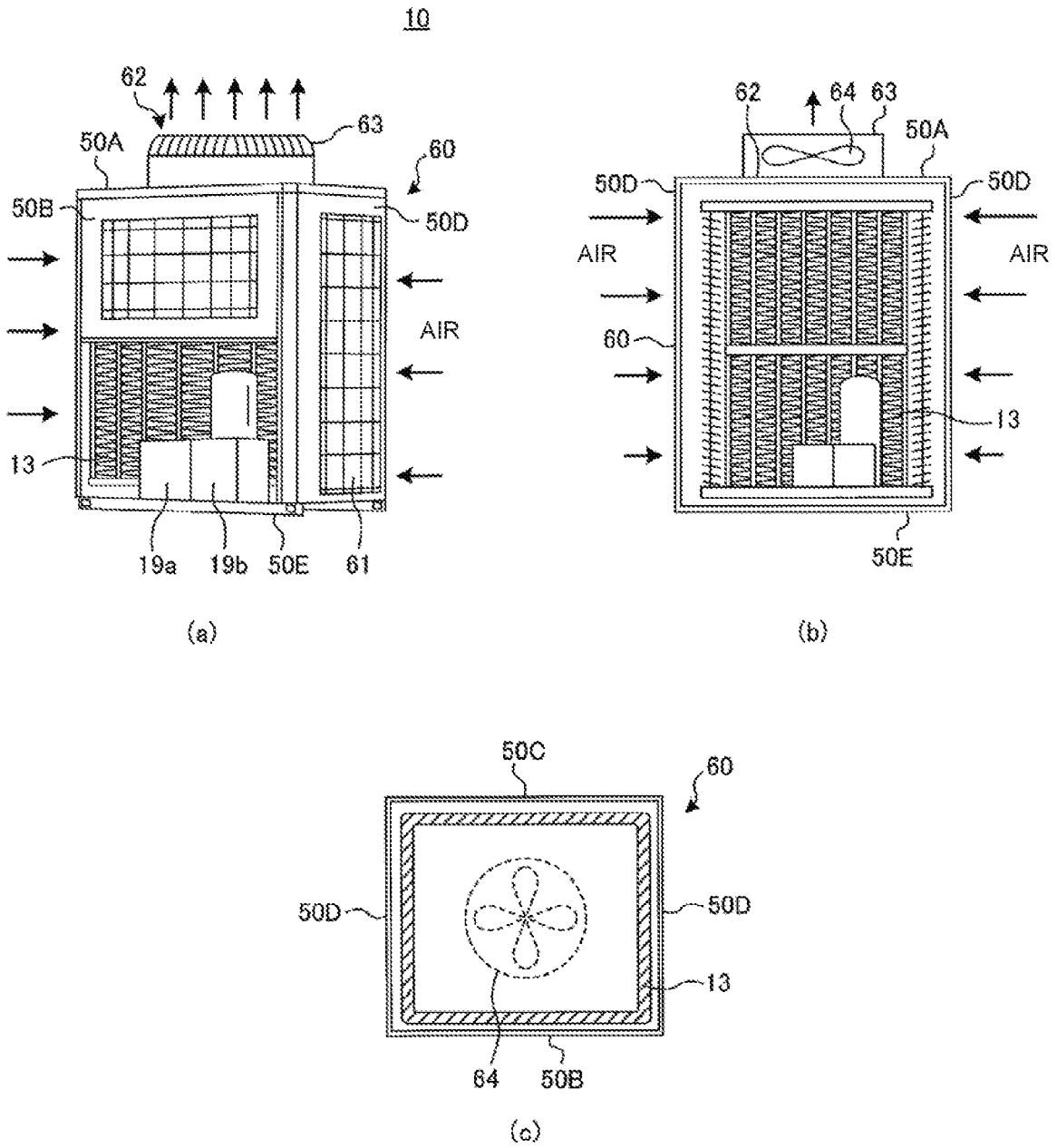
FIG. 3 are schematic views for illustrating an example of a structure of an outdoor unit in the air-conditioning apparatus according to Embodiment 1 of the present invention.

FIG. 3 are schematic views for illustrating an example of the structure of the outdoor unit 10 in the air-conditioning apparatus 1 according to Embodiment 1 of the present invention. FIG. 3(*a*) is a perspective view for illustrating an example of an outer appearance of the outdoor unit 10. FIG. 3(*b*) is a schematic sectional view of the outdoor unit 10 as viewed from a front surface side. FIG. 3(*c*) is a schematic sectional view of the outdoor unit 10 as viewed from an upper surface side.

Figure 4:
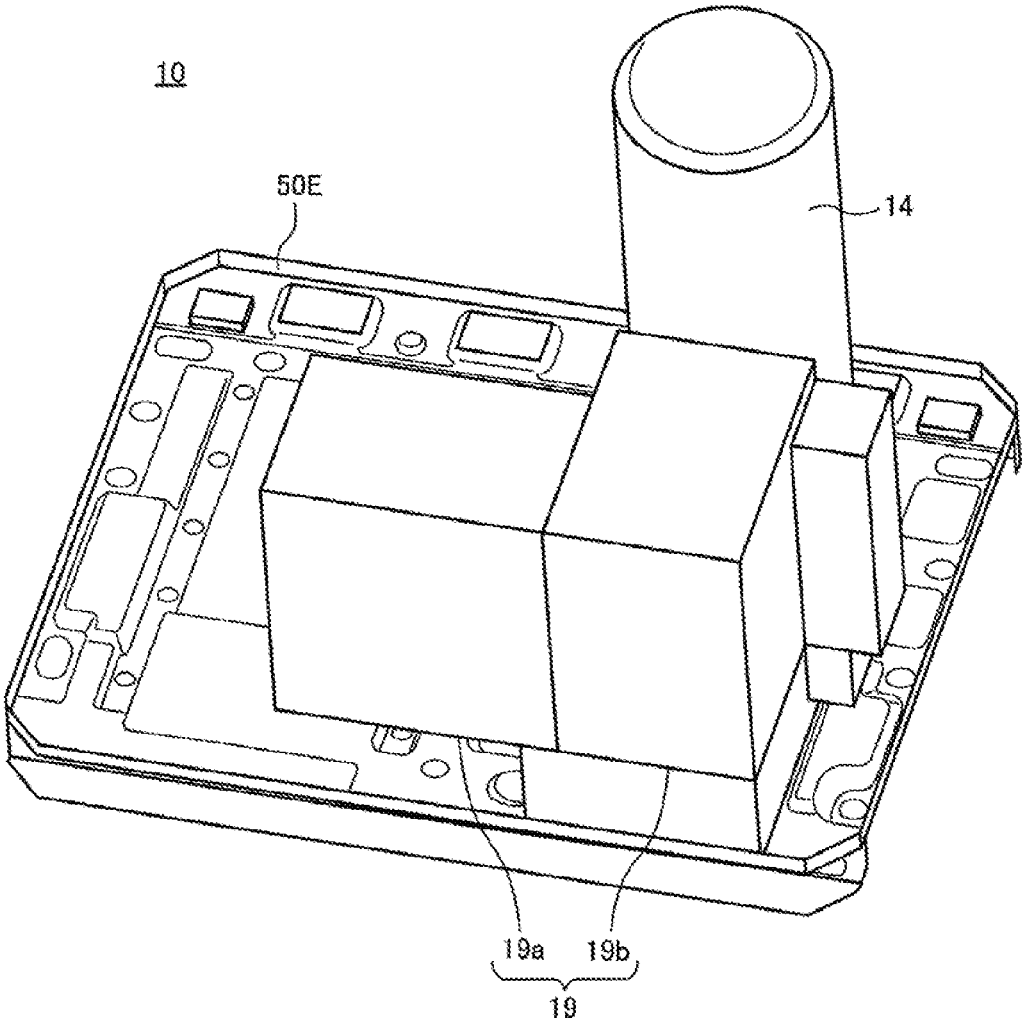
FIG. 4 is a schematic view for illustrating an example of an internal structure of the outdoor unit in the air-conditioning apparatus according to Embodiment 1 of the present invention.

FIG. 4 is a schematic view for illustrating an example of an internal structure of the outdoor unit 10 in the air-conditioning apparatus 1 according to Embodiment 1 of the present invention.

In FIG. 3(*a*), for easy understanding of the internal structure of the outdoor unit 10, an illustration of a lower portion of a front panel 50B is omitted. Similarly, in FIG. 4, there is omitted an illustration of side panels 50D and an upper panel 50A, which form an outer shell, and various devices except for the accumulator 14 and the controller 19, that is, devices such the compressor 11, the heat source-side heat exchanger 13, and the refrigerant pipes 30, which are arranged inside the outdoor unit 10.

As illustrated in FIG. 3, the outdoor unit 10 is formed in, for example, a rectangular parallelepiped shape, and the outer shell is formed of a casing 60.

The casing 60 includes the upper panel 50A, the front panel 50B, a back panel 50C, the two side panels 50D, and a bottom panel 50E.

The bottom panel 50E also serves as a drain pan and discharges, for example, drain water and rain water entering an indoor side to an outdoor side. The drain pan may be provided separately from the bottom panel 50E.

Air inlets 61 for sucking the outdoor air are formed in the front panel 50B, the back panel 50C, and the two side panels 50D.

Here, at least a surface formed by one panel among surfaces formed by the front panel 50B, the back panel 50C, and the two side panels 50D serves as a working plane that is used for maintenance work or other operations. In this example, the surface formed by the front panel 50B serves the working plane.

The front panel 50B, the back panel 50C, and the side panels 50D are provided upright along a peripheral edge portion of the bottom panel 50E. On those panels, the upper panel 50A is provided.

An air outlet 62 for releasing air in the outdoor unit 10 to the outdoor space is formed in the upper panel 50A. The air outlet 62 is formed by the heat source-side air sending device 64 such as a fan serving as an exhaust mechanism and a fan guard 63 provided to cover the periphery of the heat source-side air sending device 64.

The heat source-side heat exchanger 13 is provided to the peripheral edge portion of the bottom panel 50E along the back panel 50C and both of the side panels 50D on three sides except for the front panel 50B side, and, for example, is directly placed on the bottom panel 50E.

Further, the heat source-side heat exchanger 13 is also provided to an upper part of the front panel 50B, for example, along an upper half of the front panel 50B.

A part of the heat source-side heat exchanger 13 provided along the back panel 50C and the left side panel 50D is visible in FIG. 3(*a*). In addition, the heat source-side heat exchanger 13 is also provided along the right side surface and the upper half of the front surface.

Parts of the heat source-side heat exchanger 13 on the back surface side and on the both side surface sides are directly placed on the bottom panel 50E in this example.

However, the placement of the heat source-side heat exchanger 13 is not limited to that in this example. For example, a rack may be provided on the bottom panel 50E and the heat source-side heat exchanger 13 may be placed on the rack.

A height at which the parts of the heat source-side heat exchanger 13 on the back surface side and the both side surface sides are arranged and a height at which a part of the heat source-side heat exchanger 13 on the front surface side is arranged are not particularly limited. For example, a height position of an upper end of the heat source-side heat exchanger 13 on the back surface side and on the both side surface sides and a height position of an upper end of the heat source-side heat exchanger 13 on the front surface side may match with each other. Further, for example, the height positions of the upper ends of the heat source-side heat exchanger 13 may be different from each other.

The controller 19 is placed on the bottom panel 50E in the vicinity of a central portion of the bottom panel 50E. By placing the controller 19 on the bottom panel 50E in the vicinity of the central portion in this manner, the heat source-side heat exchanger 13 can also be provided even on the front panel 50B side as described above.

(Relationship Between Height Inside Outdoor Unit and Wind Speed)

Here, a relationship between a position inside the outdoor unit 10 in a height direction and a wind speed is described.

Figure 5:
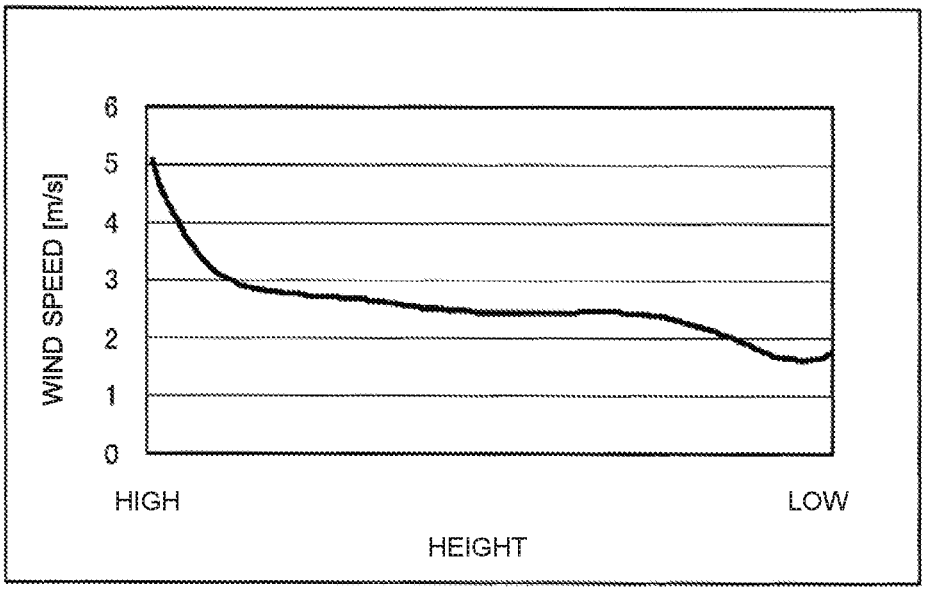
FIG. 5 is a graph for schematically showing a wind speed distribution in the outdoor unit in the air-conditioning apparatus according to Embodiment 1 of the present invention.

FIG. 5 is a graph for schematically showing a wind speed distribution in the outdoor unit 10 in the air-conditioning apparatus 1 according to Embodiment 1 of the present invention.

As shown in FIG. 5, a wind speed of air released from an inside of the outdoor unit 10 is the highest on the upper surface side, becomes lower as a position becomes lower, and is the lowest on the bottom surface side. This is because the heat source-side air sending device 64 such as a fan is provided to the upper panel 50A, and hence the wind speed becomes higher in a position closer to the heat source-side air sending device 64.

The controller has been arranged in an upper part inside the outdoor unit, which is a position close to the fan, in consideration of maintainability of the outdoor unit or other properties. In this case, however, the controller is arranged at a position where the wind speed is the highest. Thus, it is difficult to improve heat exchange performance.

On the other hand, in the outdoor unit 10 according to Embodiment 1, the heat source-side heat exchanger 13 is provided even to an upper part on the front surface side, on which the controller has been arranged. In this manner, the heat source-side heat exchanger 13 is positioned at the position where the wind speed is the highest in the outdoor unit 10. Hence, the heat exchange performance can be improved.

Further, in the outdoor unit 10, the controller 19 is arranged on the bottom surface side where the wind speed is the lowest. Consequently, the controller 19 can be prevented from hindering the flow of air. Hence, the heat exchange performance can be further improved.

(Structure of Controller)

Next, a more specific arrangement structure of the controller 19 is described.

In a case where the controller 19 is placed on the bottom panel 50E to be located in a lower half space on the front surface side, when a functional component such as the compressor 11 and the refrigerant flow switching device 12 that are arranged on a back surface side of the controller 19 is maintained, the controller 19 is required to be removed.

To entirely remove the controller 19, however, wirings inside the controller 19 are required to be all removed, and removal work takes extremely long time.

Thus, in the outdoor unit 10 according to Embodiment 1, the maintenance of the functional component is enabled without entirely removing the controller 19. That is, the controller 19 includes a plurality of controllers including a controller removably arranged and a controller arranged in a fixed manner.

Specifically, for example, the controller 19 includes, in a divided manner, a first controller 19*a* arranged with a fastener such as a bolt and a screw to be removable from the casing 60 and a second controller 19*b* that is arranged to the casing 60 in a fixed manner and is difficulty removable from the casing 60, as illustrated in FIG. 4.

Wirings for connection to at least any one of the second controller 19*b* and the functional component such as the refrigerant flow switching device 12 are provided to the first controller 19*a*. It is preferred that a margin be provided to length of each of these wirings provided to the first controller 19*a* so that the first controller 19*a* can be easily removed from the outdoor unit 10.

Although, second controller 19*b* is difficulty removable from the casing 60, the second controller 19*b* is not necessarily unremovable. However, the second controller 19*b* is not basically supposed to be removed from the casing 60. Consequently, the arrangement of the second controller 19*b* is expressed as "arranged in a fixed manner" in the following description.

As described above, in Embodiment 1, the controller 19 includes, in a divided manner, the first controller 19*a* that is removable and the second controller 19*b* arranged in a fixed manner. In this manner, a working space for the maintenance work or other operations can be ensured. Further, the controller 19 is not required to be entirely removed. Consequently, the maintenance work or other operations can be easily carried out.

The first controller 19*a* is removed from the outdoor unit 10 for the maintenance work or other operations. Consequently, it is preferred that the first controller 19*a* be reduced in total weight to be more easily removable.

For example, components such a board that has a smaller weight than these of other components are mounted in the first controller 19*a*. Meanwhile, the second controller 19*b* is arranged in a fixed manner, and hence a total weight of the second controller 19*b* is not required to be taken into consideration. Consequently, electric components such as a coil for removing noise or driving an inverter, which are larger in weight than the other components, are mounted in the second controller 19*b*.

Specifically, the electric components each having a smaller weight than that of each of the electric components mounted in the second controller 19*b* are mounted in the first controller 19*a*.

Further, electric components, each having a large heat generating amount, such as a relay and a coil are used for the controller 19. Consequently, such electric components, each having a large heat generating amount, are required to be cooled in the controller 19. As a method of cooling the electric components, each having a large heat generating amount, for example, a cooling method using a heat sink is conceivable.

However, the heat sink has a large weight. Thus, it is not preferred to arrange the heat sink to the first controller 19*a* that is removable.

Thus, in the second controller 19*b*, the electric components, each having a large heat generating amount, are mounted, while a heat sink 52 capable of sufficiently cooling the electric components is provided. Meanwhile, in the first controller 19*a*, electric components, each having a small heat generating amount or being a non-heating element, are mounted, while another heat sink 52 having a minimum necessary capacity to cool the electric components is provided.

As described above, in Embodiment 1, the electric components, each having a small weight, and the electric components, each having a small heat generating amount, are mounted in the first controller 19*a* that is removable, while the electric components, each having a large weight, and the electric components, each having a large heat generating amount, are mounted in the second controller 19*b* that is arranged in a fixed manner. As a result, the first controller 19*a* that is removed for the maintenance work can be reduced in weight. Thus, the maintenance work or other operations can be more easily carried out.

It is preferred that, as the devices arranged inside the outdoor unit 10, the functional component that is maintained at a relatively high frequency be arranged on the back surface side of the first controller 19*a* in consideration of the maintainability. The functional components that are each maintained at a relatively high frequency include, for example, the compressor 11.

The compressor 11 is arranged on the back surface side of the first controller 19*a*. As a result, for replacement or other operations of the compressor 11, the compressor 11 can be easily removed from the side of the front panel 50B that is the working plane by removing the first controller 19*a*.

Meanwhile, it is preferred that the functional component that is maintained at a relatively low frequency be arranged on the back surface side of the second controller 19*b*. The functional components that are each maintained at a relatively low frequency include, for example, the accumulator 14. For replacement or other operations of the accumulator 14, however, the heat source-side heat exchanger 13 is required to be removed as in the related-art cases.

As described above, the functional component that is maintained at a relatively high frequency such as the compressor 11 is arranged on the back surface side of the first controller 19*a*. As a result, only by removing the first controller 19*a*, the maintenance work such as the replacement can be easily carried out for the functional component that is maintained at a high frequency.

As described above, in Embodiment 1, the heat source-side heat exchanger 13 is arranged on the working plane side in the outdoor unit 10, while the heat source-side heat exchanger 13 is also arranged in the region in the vicinity of the heat source-side air sending device 64 inside the outdoor unit 10 where the wind speed is higher. As a result, the heat exchange performance can be improved.

Further, the controller 19 is arranged in the region far from the heat source-side air sending device 64 inside the outdoor unit 10 where the wind speed decreases. Consequently, the controller 19 is prevented from hindering the flow or air. Thus, the heat exchange performance can be further improved.

Specifically, in Embodiment 1, the heat source-side heat exchanger 13 on the working plane side is arranged at the position where the wind speed is higher than that at the position of the controller 19. As a result, the heat exchange performance can be improved.

Further, in Embodiment 1, the controller 19 includes, in a divided manner, the first controller 19*a* that is removable and the second controller 19*b* arranged in a fixed manner. As a result, the working space for the maintenance work or other operations can be ensured. Further, the controller 19 is not required to be entirely removed. Consequently, the maintenance work or other operations can be easily carried out.

Further, in Embodiment 1, at least any one of the electric component that has a smaller weight than these of the other components and the electric component that has a smaller heat generating amount than these of the other components is mounted in the first controller 19*a* that is removable, while at least any one of the electric component that has a larger weight than these of the other components and the electric component that has a larger heat generating amount than these of the other components is mounted in the second controller 19*b* arranged in a fixed manner.

Specifically, the weight of the first controller 19*a* that is to be removed for the maintenance work can be smaller than the weight of the second controller 19*b* in this manner. Thus, the maintenance work or other operations can be more easily carried out.

Still further, in Embodiment 1, the functional component that is maintained at a relatively high frequency is arranged on the back surface side of the first controller 19*a*. Consequently, only by removing the first controller 19*a*, the maintenance work or other operations for the functional component that is maintained at a high frequency can be easily carried out.

Both the first controller 19*a* and the second controller 19*b* are each cooled by using the heat sinks 52 in this example. However, a cooling method is not limited to that in this example. For example, the refrigerant pipes 30 may be inserted through the heat sink 52 provided to the second controller 19*b* so that the second controller 19*b* including the electric component having a large heat generating amount is cooled by heat rejection of the refrigerant flowing through the refrigerant pipes 30. This method can be used because the second controller 19*b* is not supposed to be removed from the casing 60 and is arranged in a fixed manner, and hence the insertion of the refrigerant pipes 30 through the heat sink 52 does not cause any inconvenience.

Embodiment 2

Next, the air-conditioning apparatus according to Embodiment 2 of the present invention is described.

In the related-art air-conditioning apparatus, after the controller arranged in the outdoor unit is removed, the removed controller is required to be placed outside of the outdoor unit. In this case, however, a protective covering is required to be provided to the controller to protect the controller from wind, rain, and dust.

Consequently, at the time of the maintenance work or other operations, work for providing the protective covering to the removed controller is required, and hence the maintenance work is disadvantageously complicated.

To solve this problem, in the air-conditioning apparatus 1 according to Embodiment 2, at the time of maintenance work or other operations, the first controller 19*a* arranged in the outdoor unit 10 is placed on top of the second controller 19*b* in a temporarily placed manner so that the controller 19 is protected from wind, water, dust, and other elements.

Figure 6:
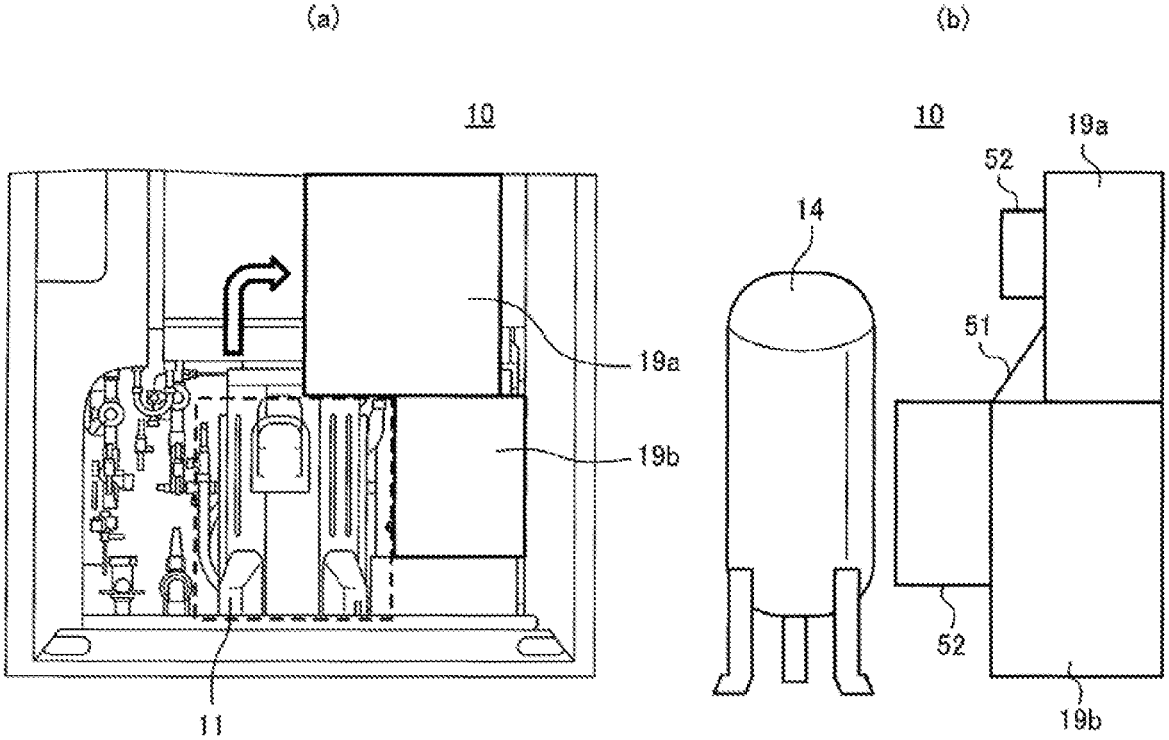
FIG. 6 are schematic views for illustrating an example of arrangement of a first controller and a second controller in the air-conditioning apparatus according to Embodiment 2 of the present invention.

FIG. 6 are schematic views for illustrating an example of arrangement of the first controller 19*a* and the second controller 19*b* in the air-conditioning apparatus 1 according to Embodiment 2 of the present invention.

In FIG. 6(*a*), there is schematically illustrated an internal structure of the outdoor unit 10 as viewed from a front surface. In FIG. 6(*a*), a portion indicated by the dotted line indicates a position at which the first controller 19*a* before removal is arranged.

As illustrated in FIG. 6(*a*), the removed first controller 19*a* is placed on top of the second controller 19*b* from the position indicated by the dotted line.

In an example illustrated in FIG. 6, the first controller 19*a* is placed on top of the second controller 19*b* after a surface of the first controller 19*a* on the front surface side is rotated by 90 degrees to be oriented to a side surface side of the second controller 19*b*.

In FIG. 6(*b*), there is schematically illustrated a positional relationship of the first controller 19*a*, the second controller 19*b*, and the accumulator 14 that are arranged inside the outdoor unit 10 when the outdoor unit 10 is viewed from the side surface.

As illustrated in FIG. 6(*b*), a fixing metal fitting 51 for temporary placement is provided to the top of the second controller 19*b*.

The fixing metal fitting 51 is formed by, for example, processing a sheet metal having a flat plate shape into a triangular shape or an L-like shape with one surface provided vertically upright. Further, the fixing metal fitting 51 is provided in, for example, a region on the back surface side on top of the second controller 19*b* and is fixed so that the surface provided vertically upright is oriented to the front surface side.

Then, the first controller 19*a* is placed, from the front surface side, on top of the second controller 19*b* along the surface of the fixing metal fitting 51 that is provided vertically upright. As a result, the first controller 19*a* can be reliably placed.

The fixing metal fitting 51 may be provided, for example, to be freely rotatable against the second controller 19*b* to be fixed at every 90 degrees. In this manner, when the first controller 19*a* is placed on the second controller 19*b*, the fixing metal fitting 51 can be oriented to a direction in which the fixing metal fitting 51 cannot be an obstruction.

Further, it is preferred that a length of the second controller 19*b* in its depth direction be set larger than a width of the first controller 19*a*. This is for the purpose of temporarily placing the first controller 19*a* in a reliable and stable manner.

Figure 7:
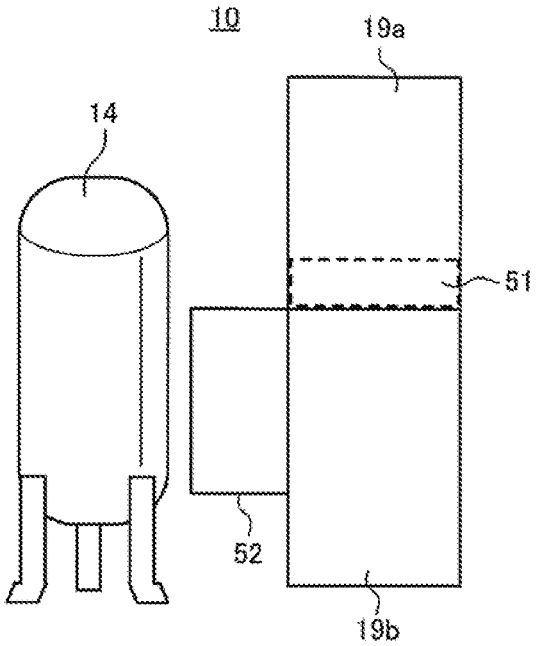
FIG. 7 is a schematic view for illustrating another example of arrangement of the first controller and the second controller in the air-conditioning apparatus according to Embodiment 2 of the present invention.

The placement of the first controller 19*a* on the second controller 19*b* is not limited to the example of FIG. 6 described above. For example, as illustrated in FIG. 7, the surface of the first controller 19*a* on the front surface side may be oriented to an engineer side, for example, to the front surface side of the second controller 19*b*.

In this manner, the engineer can carry out the maintenance work or other operations while the engineer is operating the board mounted in the first controller 19*a*.

As described above, by placing the first controller 19*a* on top of the second controller 19*b*, the first controller 19*a* is temporarily placed inside the outdoor unit 10. Consequently, the first controller 19*a* can be protected from wind, rain, dust, and other elements.

Further, the engineer who carries out the maintenance work or other operations can carry out the maintenance work or other operations without providing the protective covering to the removed first controller 19*a*. Consequently, the maintenance work can be prevented from being complicated.

In this case, the wirings for connection to at least any one of the second controller 19*b* and the functional component such as the compressor 11 and the refrigerant flow switching device 12 are provided to the first controller 19*a* as described above. Consequently, when the first controller 19*a* is placed on top of the second controller 19*b*, it is suitable to set, for example, the length of each of the wirings connected from the functional component to the first controller 19*a* larger than a necessary length to provide a margin to the length.

The "necessary length" of the wirings refers to a minimum length that allows the placement of the first controller 19*a* on top of the second controller 19*b* without removing the wirings connected to the first controller 19*a*.

Further, for example, the wirings having an increased length may be formed in a spiral shape and may be expanded and contracted corresponding to tensile force applied to the wirings to have a varying length. In this manner, during normal time during which the tensile force is not applied, the length of each of the wirings is substantially equal to the necessary length. Consequently, a space for accommodating the wirings having the increased length is not required to be taken into consideration.

As described above, the length of each of the wirings connected to the first controller 19*a* is set larger than the necessary length to provide the margin to the length. As a result, the first controller 19*a* can be placed on top of the second controller 19*b* without removing the wirings connected to the first controller 19*a*. Further, the wirings are not required to be removed, and hence the maintenance work or other operations can be carried out under a state in which the outdoor unit 10 is operated.

When the length of each of the wirings connected to the first controller 19*a* is increased as described above, a space for accommodating surplus wirings is required. Further, the wirings are sometimes entangled.

Further, the wirings are sometimes protected with a protective member such as a tube for each of the wirings for the purpose of ensuring heat resistance and weather resistance. Consequently, the thickness of each of the wirings is sometimes large.

In such a case, for example, it is suitable to bond coatings of the plurality of wirings with a resin or other materials to each other, to bind the windings into a single wiring bundle, and to protect the winding bundle with a single protective member. In this manner, the extended wirings can be prevented from being entangled.

Further, each of the wirings is not required to be protected with the protective member. Consequently, the thickness of each of the wirings connected to the first controller 19*a* can be prevented from being increased.

As described above, according to Embodiment 2, by placing the removed first controller 19*a* on top of the second controller 19*b*, the first controller 19*a* is temporarily placed inside the outdoor unit 10. Thus, the first controller 19*a* can be protected from wind, rain, dust, or other elements.

Further, owing to the protection described above, the protective covering is not required to be provided to the first controller 19*a*. Thus, the maintenance work to be carried out by the engineer can be prevented from being complicated.

Further, according to Embodiment 2, the length of each of the wirings connected to the first controller 19*a* is set larger than the necessary length to provide the margin to the length. In this manner, the first controller 19*a* can be placed on top of the second controller 19*b* without removing the wirings, while the maintenance work or other operations can be carried out under a state in which the outdoor unit 10 is operated.

Further, when the length of each of the wirings is set long, the bundle formed by bonding the coatings of the plurality of wirings to each other is protected with the single protective member. Consequently, the extended wirings can be prevented from being entangled, while the thickness of each of the wirings can be prevented from being increased.

In Embodiment 2, the refrigerant pipes 30 may be inserted through the heat sink 52 that is provided to the second controller 19*b* so that the second controller 19*b* is cooled by the heat rejection from the refrigerant flowing through the refrigerant pipes 30 as in Embodiment 1. This method can be used because the removal of the second controller 19*b* from the casing 60 is not supposed, and hence the insertion of the refrigerant pipes 30 through the heat sink 52 does not cause any inconvenience.

Embodiment 3

Next, the air-conditioning apparatus according to Embodiment 3 of the present invention is described.

In the air-conditioning apparatus 1 according to Embodiment 3, one of the first controller 19*a* and the second controller 19*b* that are provided in a divided manner is placed on top of the other one.

As described in Embodiment 1, the wind speed of the air released from the inside of the outdoor unit 10 becomes the highest on the upper surface side that is close to the heat source-side air sending device 64 and becomes the lowest on the bottom surface side. Consequently, a cooling effect is higher for the controller 19 that is arranged on the upper side than for the controller 19 that is arranged on the lower side. Thus, in Embodiment 3, the second controller 19*b* including the electric components having a large heat generating amount is placed on top of the first controller 19*a*.

Figure 8:
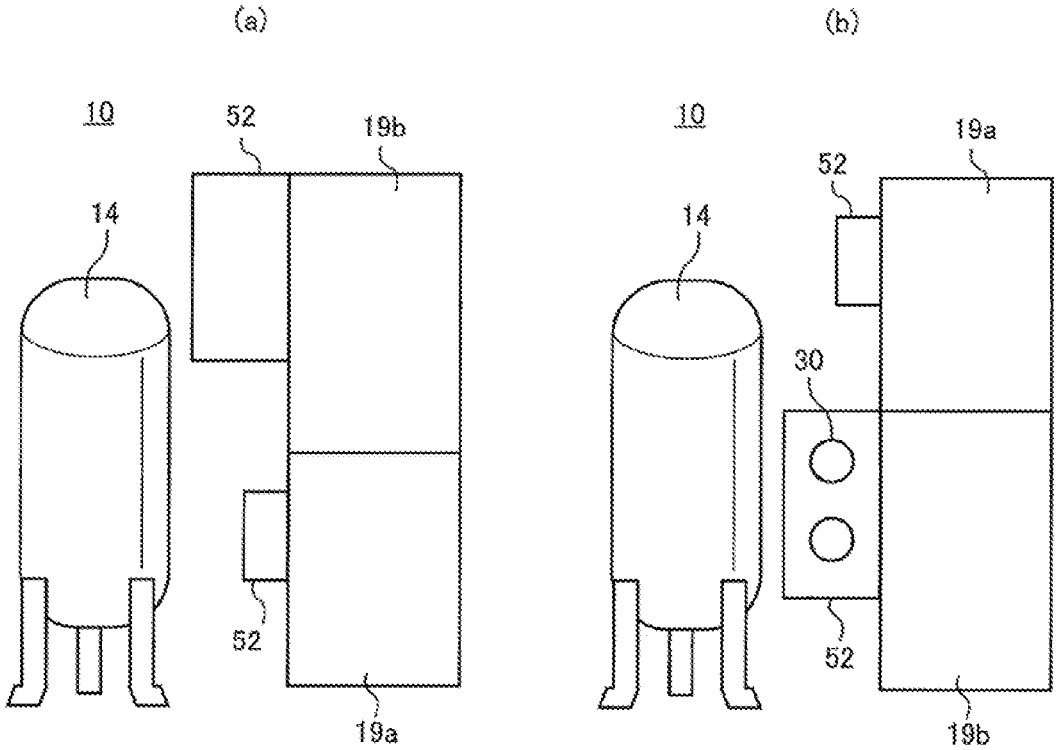
FIG. 8 are schematic views for illustrating an example of arrangement of the first controller and the second controller in the air-conditioning apparatus according to Embodiment 3 of the present invention.

FIG. 8 are schematic views for illustrating an example of arrangement of the first controller 19*a* and the second controller 19*b* in the air-conditioning apparatus 1 according to Embodiment 3 of the present invention.

As illustrated in FIG. 8(*a*), the second controller 19*b* is placed on top of the first controller 19*a*. The second controller 19*b* is removably arranged with a fastener such as a bolt and a screw and fixed to the first controller 19*a*. The first controller 19*a* may be fixed to the casing 60 (see FIG. 3) to be difficulty removable or may be removably fixed.

It is preferred that the first controller 19*a* and the second controller 19*b* be arranged, for example, on a front surface side of the functional component that is maintained at a relatively low frequency such as the accumulator 14. This arrangement is adopted to ensure the working space for carrying out the maintenance work such as the replacement of the functional component that is maintained at a relatively high frequency such as the compressor 11.

As described above, by placing the second controller 19*b* including the electric component having a large heat generating amount on top of the first controller 19*a*, the second controller 19*b* is arranged at the position inside the outdoor unit 10 where the wind speed is higher. Consequently, the cooling effect for the second controller 19*b* can be enhanced.

The second controller 19*b* is placed on top of the first controller 19*a* in the example illustrated in FIG. 8(*a*). In the second controller 19*b*, the electric components, each having a larger weight than that of each of the electric components mounted in the first controller 19*a*, are mounted. Consequently, for example, when the cooling effect for the second controller 19*b* is not required to be enhanced or in other cases, the first controller 19*a* that has a relatively small weight may be placed on top of the second controller 19*b* to arrange the controller 19 inside the casing 60 in a more stable state.

As described in Embodiment 1 and Embodiment 2, it is conceivable to insert the refrigerant pipes 30 through the heat sink 52 to use the heat rejection of the refrigerant flowing through the refrigerant pipes 30 as the method of cooling the second controller 19*b* including the electric component having a large heat generating amount. When the second controller 19*b* is cooled in this manner, however, the second controller 19*b* cannot be removed.

Consequently, when the heat rejection of the refrigerant flowing through the refrigerant pipes 30 is used as the method of cooling the second controller 19*b*, as illustrated in FIG. 8(*b*), the second controller 19*b* is fixed to the casing 60, and the first controller 19*a* is placed on top of the second controller 19*b*. In this case, similarly to the example described above, the first controller 19*a* is removably fixed to the second controller 19*b* with a fastener.

As described above, even when the heat rejection of the refrigerant flowing through the refrigerant pipes 30 is used as the method of cooling the second controller 19*b*, similarly to the above-mentioned example, the working space for the maintenance work or other operations can be ensured while the cooling effect for the first controller 19*a* can be enhanced by placing the first controller 19*a* on top of the second controller 19*b*. Further, even when the second controller 19*b* is arranged on the bottom surface side where the wind speed is low, a sufficient cooling effect can be ensured owing to the heat rejection of the refrigerant.

As described above, in Embodiment 3, the first controller 19*a* and the second controller 19*b* are arranged inside the casing 60 and one of the first controller 19*a* and the second controller 19*b* are placed on top of the other one of the first controller 19*a* and the second controller 19*b*. As a result, the cooling effect for the one controller 19 arranged at the position where the wind speed is higher can be enhanced. Further, in this manner, the working space for carrying out the maintenance work can be ensured.

The one controller 19 is not limited to be placed on top of the other controller 19 and may be placed, for example, on top of a compressor box (not shown) configured to accommodate the compressor 11. Even in this manner, the one controller 19 is arranged at the position where the wind speed is higher. Thus, the same effects as those described above can be obtained.

Embodiment 4

Next, the air-conditioning apparatus according to Embodiment 4 of the present invention is described.

In the air-conditioning apparatus 1 according to Embodiment 4, the electric component with a large heat generating amount and the electric component with a small heat generating amount are arranged at different positions inside the single controller 19.

Figure 9:
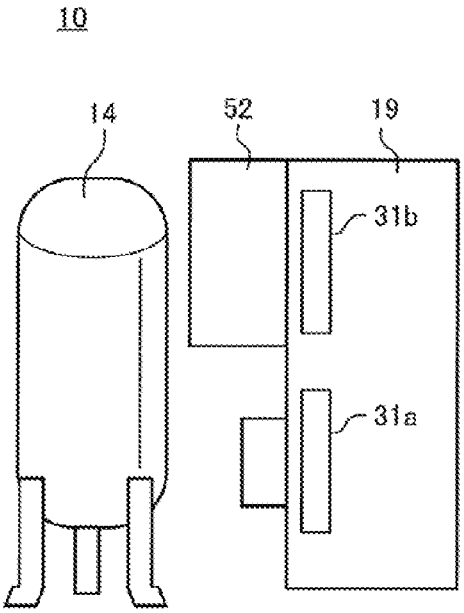
FIG. 9 is a schematic view for illustrating an example of arrangement of the controller in the air-conditioning apparatus according to Embodiment 4 of the present invention.

FIG. 9 is a schematic view for illustrating an example of arrangement of the controller 19 in the air-conditioning apparatus 1 according to Embodiment 4 of the present invention.

As illustrated in FIG. 9, in Embodiment 4, an electric component 31*a* including a board that has a relatively small heat generating amount and a small weight (hereinafter appropriately referred to as "low heat-generating electric component") and an electric component 31*b* including a board that has a larger heat generating amount and has a larger weight than those of the low heat-generating electric component 31*a* (hereinafter appropriately referred to as "heat-generating electric component") are arranged at different positions to be mounted inside the single controller 19.

Specifically, the low heat-generating electric component 31*a* is arranged on a lower side inside the controller 19, whereas the heat-generating electric component 31*b* is arranged on an upper side inside the controller 19. Further, the heat sink 52 is provided to the controller 19 at a position corresponding to each of the low heat-generating electric component 31*a* and the heat-generating electric component 31*b*.

It is preferred that the controller 19 be arranged, for example, on the front surface side of the electric component that is maintained at a relatively low frequency, such as the accumulator 14. This arrangement is used to ensure the working space for carrying out the maintenance work such as the replacement of the functional component that is maintained at a relatively high frequency such as the compressor 11.

As described above, the heat-generating electric component 31*b* having a large heat generating amount is arranged at the position higher than the position of the low heat-generating electric component 31*a* having a small heat generating amount. As a result, the heat-generating electric component 31*b* is arranged at the position inside the outdoor unit 10 where the wind speed is higher. Consequently, the cooling effect for the heat-generating electric component 31*b* can be enhanced.

In the example illustrated in FIG. 9, there is described the case where the heat-generating electric component 31*b* is arranged at the position higher than the position of the low heat-generating electric component 31*a*. However, the heat-generating electric component 31*b* has a larger weight than that of the low heat-generating electric component 31*a*. Consequently, when, for example, the cooling effect for the heat-generating electric component 31*b* is not required to be enhanced or in other cases, the low heat-generating electric component 31*a* that has a relatively small weight may be arranged at a position higher than the position of the heat-generating electric component 31*b* to arrange the controller 19 inside the casing 60 (see FIG. 3) in a more stable state.

Further, for example, even when the refrigerant pipes 30 are inserted through the heat sink 52 to more cool the heat-generating electric component 31*b*, the heat-generating electric component 31*b* may be arranged on the lower side inside the controller 19 while the low heat-generating electric component 31*a* may be arranged on the upper side inside the controller 19. It is noted, when the refrigerant pipes 30 are inserted through the heat sink 52, the controller 19 is difficultly removable from the casing 60.

As described above, in Embodiment 4, the low heat-generating electric component 31*a* and the heat-generating electric component 31*b* are arranged at the different positions inside the single controller 19. As a result, the cooling effect for the electric component arranged on the upper side can be enhanced. In particular, when the heat-generating electric component 31*b* is arranged on the upper side inside the controller 19, the cooling effect is sufficiently exerted.

Embodiment 5

Next, the air-conditioning apparatus according to Embodiment 5 of the present invention is described.

For example, a case where both the low heat-generating electric component 31*a* and the heat-generating electric component 31*b* that are arranged inside the controller 19 are cooled by the heat rejection of the refrigerant flowing through the refrigerant pipes 30 is considered. In this case, when the refrigerant temperature is set to a temperature corresponding to the heat-generating electric component 31*b* with a large heat generating amount, the low heat-generating electric component 31*a* is excessively cooled to sometimes cause dew condensation around the low heat-generating electric component 31*a*. Consequently, in Embodiment 5, the refrigerant pipes 30*a* are provided to the bottom surface side of the controller 19 to reduce effects of the dew condensation on the low heat-generating electric component 31*a*.

Figure 10:
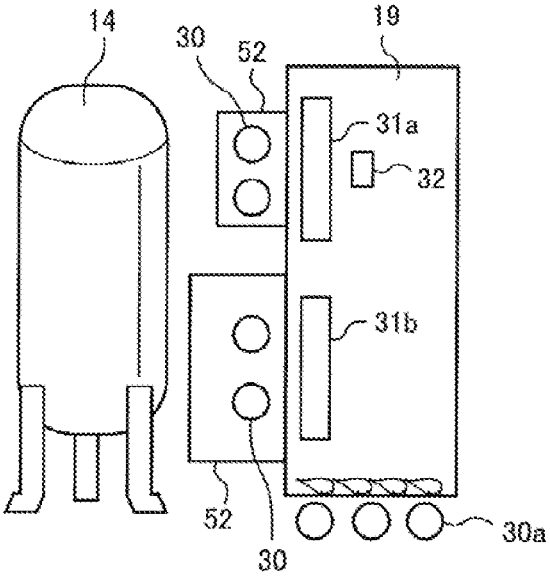
FIG. 10 is a schematic view for illustrating an example of arrangement of the controller in the air-conditioning apparatus according to Embodiment 5 of the present invention.

FIG. 10 is a schematic view for illustrating an example of arrangement of the controller 19 in the air-conditioning apparatus 1 according to Embodiment 5 of the present invention.

As illustrated in FIG. 10, in Embodiment 5, the low heat-generating electric component 31*a* and the heat-generating electric component 31*b* are arranged at different positions to be mounted inside the single controller 19. Specifically, the low heat-generating electric component 31*a* is arranged on the upper side inside the controller 19, whereas the heat-generating electric component 31*b* is arranged on the lower side inside the controller 19. Further, the heat sink 52 is provided to the controller 19 at a position corresponding to each of the low heat-generating electric component 31*a* and the heat-generating electric component 31*b*, and the refrigerant pipes 30 are inserted through each of the heat sinks 52.

Further, to the bottom surface side of the controller 19, refrigerant pipes 30*a* are provided. In the vicinity of the low heat-generating electric component 31*a*, a humidity sensor 32 is provided. The humidity sensor 32 is configured to measure a humidity around the low heat-generating electric component 31*a*.

In Embodiment 5, the refrigerant temperature in the refrigerant pipes 30*a* provided to the bottom surface of the controller 19 is decreased corresponding to the humidity measured by the humidity sensor 32 to dehumidify the controller 19 so that the humidity around the low heat-generating electric component 31*a* does not cause the dew condensation.

At this time, the dew condensation is sometimes caused around the refrigerant pipes 30*a* by decreasing the temperature of the refrigerant flowing through the refrigerant pipes 30*a*. Water droplets generated due to the dew condensation are accumulated on the bottom surface of the controller 19. Consequently, the low heat-generating electric component 31*a* and the heat-generating electric component 31*b* can be prevented from being wet with the water droplets.

As described above, in Embodiment 5, the humidity sensor 32 is provided in the vicinity of the low heat-generating electric component 31*a*. At the same time, the refrigerant pipes 30*a* are provided to the bottom surface side of the controller 19, and the temperature of the refrigerant flowing through the refrigerant pipes 30*a* is decreased corresponding to the humidity measured by the humidity sensor 32. In this manner, the controller 19 can be dehumidified. Further, during the dehumidification, the low heat-generating electric component 31*a* and the heat-generating electric component 31*b* can be prevented from being wet with the water droplets generated by decreasing the refrigerant temperature in the refrigerant pipes 30*a*.

Embodiment 1 to Embodiment 5 of the present invention are described above, but the present invention is not limited to Embodiment 1 to Embodiment 5 of the present invention described above. Various modifications and applications can be made without departing from the gist of the present invention.

The invention claimed is:

1. An outdoor unit, comprising:

a compressor configured to compress refrigerant;

a fan configured to suck air;

a heat source-side heat exchanger configured to exchange heat between the refrigerant and the air;

a controller configured to control the compressor, the fan, and the heat source-side heat exchanger; and a casing accommodating the compressor, the fan, the heat source-side heat exchanger, and the controller, the fan being provided in an upper part of the casing, the controller being provided in a lower half of the casing, the heat source-side heat exchanger being provided along outer peripheral side surfaces of the casing, a part of the heat source-side heat exchanger being provided along a working plane used by an engineer for maintenance work and being provided above the controller, the controller including a first controller arranged removably from the casing and a second controller fixed to the casing, and the first controller including at least one of a first electric component having a heat generating amount smaller than a heat generating amount of a second electric component mounted in the second controller and the first electric component having a smaller weight than a weight of the second electric component mounted in the second controller; and wherein the controller is provided on a bottom surface of the casing.

2. The outdoor unit of claim 1, wherein a fixing metal fitting is provided to top of the second controller, the fixing metal fitting being configured to fix the first controller for temporary placement.

3. The outdoor unit of claim 1, wherein, on top of the second controller, the first controller is placed.

4. The outdoor unit of claim 1, wherein the first controller is arranged removably from the casing by a bolt and screw used to fasten the first controller to the casing.

5. An air-conditioning apparatus, comprising:

an outdoor unit including:

a compressor configured to compress refrigerant, a fan configured to suck air, a heat source-side heat exchanger configured to exchange heat between the refrigerant and the air, a controller configured to control the compressor, the fan, and the heat source-side heat exchanger, and a casing accommodating the compressor, the fan, the heat source-side heat exchanger, and the controller; and an indoor unit including:

an expansion device, and a use-side heat exchanger, in the outdoor unit:

the fan being provided in an upper part of the casing, the controller being provided in a lower half of the casing, the heat source-side heat exchanger being provided along outer peripheral side surfaces of the casing, a part of the heat source-side heat exchanger being provided along a working plane used by an engineer for maintenance work and being provided above the controller, the controller including a first controller arranged removably from the casing and a second controller fixed to the casing, and the first controller including at least one of a first electric component having a heat generating amount smaller than a heat generating amount of a second electric component mounted in the second controller and the first electric component having a smaller weight than a weight of the second electric component mounted in the second controller; and wherein the controller is provided on a bottom surface of the casing.

6. An outdoor unit, comprising:

a compressor configured to compress refrigerant;

a fan configured to suck air;

a heat source-side heat exchanger configured to exchange heat between the refrigerant and the air;

a controller configured to control the compressor, the fan, and the heat source-side heat exchanger; and a casing accommodating the compressor, the fan, the heat source-side heat exchanger, and the controller, wherein:

the fan is provided in an upper part of the casing, the controller is provided in a lower half of the casing, the heat source-side heat exchanger is provided along outer peripheral side surfaces of the casing, a part of the heat source-side heat exchanger is provided along a working plane used by an engineer for maintenance work and is provided above the controller, the controller includes a first controller arranged removably from the casing and a second controller fixed to the casing, the first controller includes at least one of a first electric component having a heat generating amount smaller than a heat generating amount of a second electric component mounted in the second controller and the first electric component having a smaller weight than a weight of the second electric component mounted in the second controller, a fixing metal fitting is provided to a top of the second controller, the fixing metal fitting being configured to fix the first controller for temporary placement, and the first controller includes a wiring connected to at least any one of the second controller and the compressor, the wiring having a length longer than a minimum length that allows the first controller to be placed on top of the second controller without removing the wiring.

7. The outdoor unit of claim 6, wherein the wiring is formed in a spiral shape and is expanded and contracted corresponding to tensile force.

8. The outdoor unit of claim 6, wherein a plurality of the wirings are bound in a single bundle and protected with a tube.

9. An outdoor unit, comprising:

a compressor configured to compress refrigerant;

a fan configured to suck air;

a heat source-side heat exchanger configured to exchange heat between the refrigerant and the air;

a controller configured to control the compressor, the fan, and the heat source-side heat exchanger; and a casing accommodating the compressor, the fan, the heat source-side heat exchanger, and the controller, wherein:

the fan is provided in an upper part of the casing, the controller is provided in a lower half of the casing, the heat source-side heat exchanger is provided along outer peripheral side surfaces of the casing, a part of the heat source-side heat exchanger is provided along a working plane used by an engineer for maintenance work and is provided above the controller, the controller includes a first controller arranged removably from the casing and a second controller fixed to the casing, the first controller includes at least one of a first electric component having a heat generating amount smaller than a heat generating amount of a second electric component mounted in the second controller and the first electric component having a smaller weight than a weight of the second electric component mounted in the second controller, a heat sink is provided to the second controller, the heat sink being configured to cool the second electric component mounted in the second controller, and a pipe through which the refrigerant flows is inserted through the heat sink.

10. An outdoor unit, comprising:

a compressor configured to compress refrigerant;

a fan configured to suck air;

a heat source-side heat exchanger configured to exchange heat between the refrigerant and the air;

a controller configured to control the compressor, the fan, and the heat source-side heat exchanger; and a casing accommodating the compressor, the fan, the heat source-side heat exchanger, and the controller, the fan being provided in an upper part of the casing, the controller being provided in a lower part of the casing, the heat source-side heat exchanger being provided along outer peripheral side surfaces of the casing, a part of the heat source-side heat exchanger being provided along a working plane used by an engineer for maintenance work and being provided above the controller, and the controller including:

a first heat-generating electric component having a first heat generating amount and a second heat-generating electric component having a second heat generating amount, the second heat generating amount being larger than the first heat generating amount, the first heat-generating electric component and the second heat-generating electric component being arranged at different heights, a humidity sensor configured to measure a humidity around the first heat-generating electric component, a heat sink being inserted through by a first pipe through which the refrigerant flows, the heat sink being configured to cool the first heat-generating electric component and the second heat-generating electric component, and a second pipe through which the refrigerant flows, the second pipe being provided to a bottom surface side of the controller, the controller being configured to control a temperature of the refrigerant flowing through the second pipe corresponding to the humidity measured by the humidity sensor to prevent dew condensation around the first heat-generating electric component.

11. The outdoor unit of claim 10, wherein the second heat-generating electric component is arranged at a position higher than a position of the first heat-generating electric component.

12. The air-conditioning apparatus of claim 5, wherein the first controller is arranged removably from the casing by a bolt and screw used to fasten the first controller to the casing.

13. An air-conditioning apparatus, comprising:

an outdoor unit including:

a compressor configured to compress refrigerant, a fan configured to suck air, a heat source-side heat exchanger configured to exchange heat between the refrigerant and the air, a controller configured to control the compressor, the fan, and the heat source-side heat exchanger, and a casing accommodating the compressor, the fan, the heat source-side heat exchanger, and the controller; and an indoor unit including:

an expansion device, and a use-side heat exchanger, in the outdoor unit:

the fan being provided in an upper part of the casing, the controller being provided in a lower part of the casing, the heat source-side heat exchanger being provided along outer peripheral side surfaces of the casing, a part of the heat source-side heat exchanger being provided along a working plane used by an engineer for maintenance work and being provided above the controller, the controller including:

a first heat-generating electric component having a first heat generating amount and a second heat-generating electric component having a second heat generating amount, the second heat generating amount being larger than the first heat generating amount, the first heat-generating electric component and the second heat-generating electric component being arranged at different heights, a humidity sensor configured to measure a humidity around the first heat generating electric component, a heat sink being inserted through by a first pipe through which the refrigerant flows, the heat sink being configured to cool the first heat-generating electric component and the second heat-generating electric component, and a second pipe through which the refrigerant flows, the second pipe being provided to a bottom surface side of the controller, the controller being configured to control a temperature of the refrigerant flowing through the second pipe corresponding to the humidity measured by the humidity sensor to prevent dew condensation around the low heat-generating electric component.

* * * * *